United States Patent [19]

Outram

[11] 4,099,360

[45] Jul. 11, 1978

[54] METHOD AND DEVICE FOR JOINING CONCRETE BODIES AND METHOD OF CONSTRUCTING A MULTI-STORY BUILDING

[75] Inventor: Christopher David Outram, Thames Ditton, England

[73] Assignee: CCL Systems, Ltd., Surbiton, England

[21] Appl. No.: 686,450

[22] Filed: May 13, 1976

[30] Foreign Application Priority Data

May 13, 1975 [GB] United Kingdom ..... 20185/75

[51] Int. Cl.[2] ..... E04G 21/00

[52] U.S. Cl. ..... 52/745; 52/122; 52/583; 52/741

[58] Field of Search ..... 52/726, 741, 583, 433, 52/442, 438, 122, 126, 744, 259, 260, 253, 745

[56] References Cited

U.S. PATENT DOCUMENTS

| | | | |
|---|---|---|---|
| 2,724,261 | 11/1955 | Rensaa | 52/259 |
| 3,300,943 | 1/1967 | Owens | 52/744 |
| 3,562,979 | 2/1971 | Ali-Oglu | 52/259 |
| 3,613,325 | 10/1971 | Yee | 52/726 |
| 3,737,955 | 6/1973 | McKinnon | 52/726 |
| 3,867,805 | 2/1975 | Mikami | 52/726 |
| 3,916,592 | 11/1975 | Morohashi | 52/723 |

FOREIGN PATENT DOCUMENTS

| | | | |
|---|---|---|---|
| 708,726 | 7/1931 | France | 52/583 |
| 962,932 | 5/1957 | Fed. Rep. of Germany | 52/583 |
| 2,205,772 | 8/1973 | Fed. Rep. of Germany | 52/726 |
| 452,520 | 8/1936 | United Kingdom | 52/583 |
| 689,167 | 3/1949 | United Kingdom | 52/583 |

*Primary Examiner*—Ernest R. Purser
*Assistant Examiner*—Henry Raduazo
*Attorney, Agent, or Firm*—Caesar, Rivise, Bernstein & Cohen, Ltd.

[57] ABSTRACT

A method of erecting multi-story buildings by joining spaced elongated vertical columns of concrete. The method comprises providing a screw threaded metal socket in the face of each column to be connected. The socket of one column has a thread opposite in direction to that of the socket in the other column. One column is disposed over the other with the mouth of the sockets aligned. An elongated coupling, having an external threaded portion at each end, with the thread at one portion being opposite to the direction of the thread in the other portion and including an intermediate portion having a grip surface, is disposed between the sockets and rotated via its grip surface while the columns are spaced so as to simultaneously screw the threaded portions into the corresponding sockets by a sufficient distance to adjust the spacing between the sockets such that the upper column remains spaced above the lower column but supported thereon by the connection between the sockets and the coupling, with the spacing between the sockets being defined by the length of the intermediate portion of the coupling.

5 Claims, 4 Drawing Figures

METHOD AND DEVICE FOR JOINING CONCRETE BODIES AND METHOD OF CONSTRUCTING A MULTI-STORY BUILDING

The invention relates to a method of and device for joining concrete bodies and to a method of constructing multi-storey buildings.

In constructing multi-storey buildings using precast concrete columns it is necessary to attach one column upon another in accurate alignment before floors and other cross-members are cast or secured in place. A known method of securing one column upon another comprises locating the ends of reinforcing bars protruding from one column in sockets provided in the end of the other column, aligning the two columns, and securing the bars in their respective sockets using a cementitious or other grout. In another known method, the columns are positioned so that reinforcing bars protruding from their ends overlap, the gap between the two columns, around the bars, is filled with concrete, and the upper column is held in accurate alignment with the lower column until the concrete has gained sufficient strength to permit the supports to be removed. In yet another method, flat steel plates are bonded to the columns by means of tangs protruding from the plates. The plates each have a bevelled edge which is positioned accurately at the end of the column, and the opposed bevelled edges in the two columns are welded together to secure them together. All these methods require the columns to be supported for a considerable period of time, either by a tower crane or by accurately positioned props, depending upon the location. In the former two methods, extreme accuracy in positioning and holding the columns is required, whilst in the latter method, the positioning of the steel plates also requires great accuracy.

It is an object of the invention to provide a method of joining concrete bodies which, after the initial positioning of the bodies relative to one another, does not require prolonged external support, and which method is therefore considerably more rapid and therefore more economical than existing methods.

According to the invention, a method of joining two concrete bodies comprises providing in a face of each body at least one screw-threaded metal socket, the or each socket in one body having a thread opposite in direction to that in the or each socket of the other body, positioning the two bodies so as to align the mouth of a socket in one body with the mouth of a socket in the other body, locating between the two sockets a coupling having an externally-threaded portion at each end, the thread on one portion being opposite in direction to that on the other portion, and rotating the coupling so as to simultaneously screw the threaded portions into the corresponding sockets.

The invention also provides a device for joining concrete bodies which comprises a pair of screw-threaded sockets whose screw threads run in mutually opposite directions, and a coupling having at either end a portion externally threaded such that it may be screwed into a respective one of the sockets.

According to another aspect of the invention, a method of constructing a multi-storey building comprises locating one precast concrete column above another, a threaded metal socket being located in the end face of each column, and locating between the columns a coupling, the coupling having a threaded portion at each end, the threaded end portions being of different hands and threading an end portion of the coupling into a socket of each column.

The sockets may each have an unthreaded portion which is swaged on to the end of a concrete-reinforcing bar, the body of concrete being cast about the bar such that at least the mouth of each socket is accessible. If desired, the whole of either socket or both sockets extends from the concrete body.

The concrete bodies may be elongate vertical columns for use in the construction of multi-storey buildings, and the positioning step then comprises suspending one column above a second, fixed, column and aligning the mouths of opposed sockets.

Preferably there are three such pairs of sockets so that by the tripod construction the column assembly may be equally supported on each socket. The tripod arrangement also makes it possible to adjust the assembly in the vertical plane.

The invention includes the constructed building.

An embodiment of the invention is illustrated in the accompanying diagrammatic drawings, in which.

Figure 1:
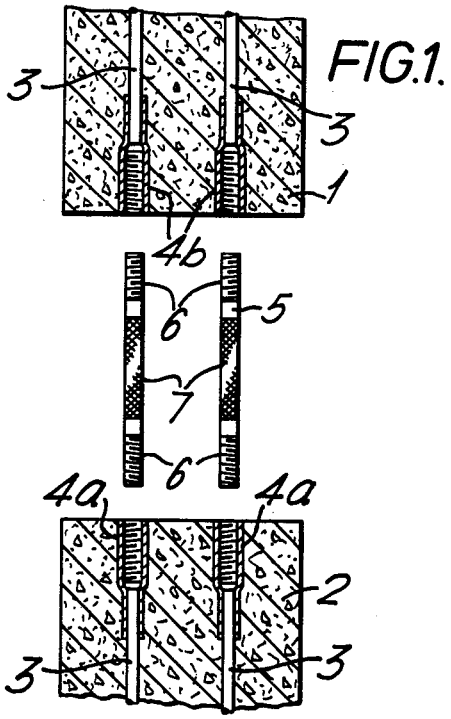
FIG. 1 is an exploded elevation of a two column assembly.
Figure 2:
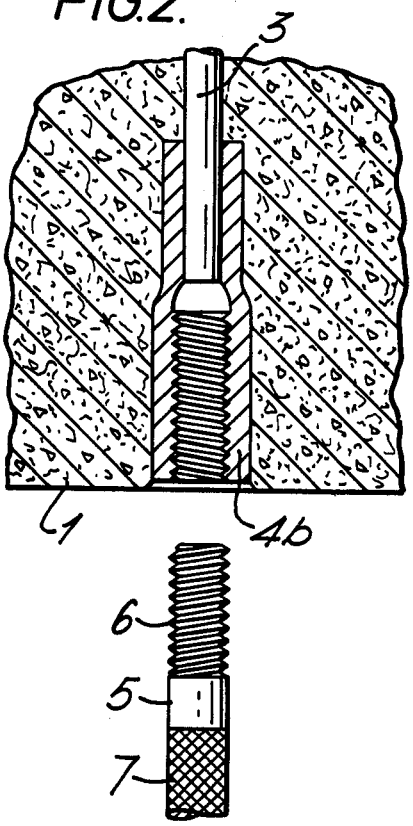
FIG. 2 shows a detail of FIG. 1 to a much enlarged scale.
Figure 3:
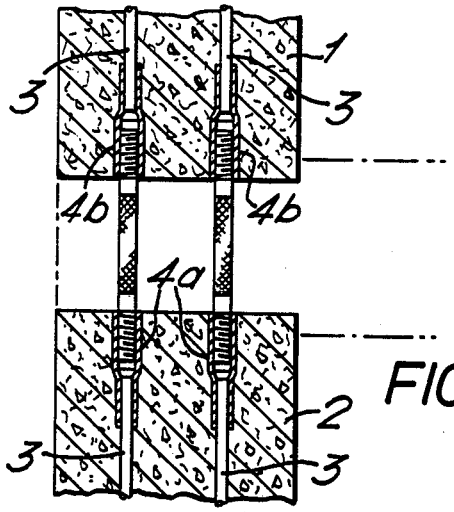
FIG. 3 is the same as FIG. 2, but after the assembly has been made.
Figure 4:
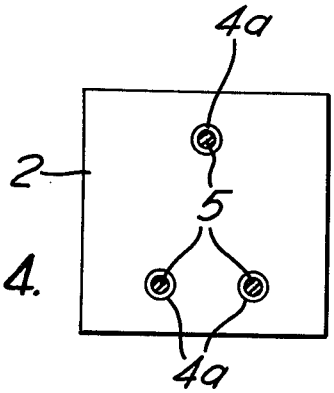
FIG. 4 is a sectional view taken through an alternative embodiment of the invention utilizing three couplings.--

The assembly of FIG. 1 to 3 shows the lower portion of an upper column 1 and the upper portion of a lower column 2. Each column is precast of concrete and has a metal reinforcement 3. Four metal sockets **4*a*, 4*b*,** are precast into the end wall of the column.

The columns can be joined together by means of couplers 5. The end portions 6 of the couplers are screw threaded but of opposite habds. The centre portion 7, which maybe of any reasonable length of the couplers has grip surfaces.

In use, the upper column 1 is lowered towards the other column 2 (or a foundation block into which the sockets have been cast), by means of a tower crane or the like. The couplers 5 are located between them, one end portion being screwed into the upper metal socket **4*a* for a distance of about one threadwidth. As the upper column is further lowered, the other end portion of each coupler 5 is screwed into the lower metal socket 4*b*, and simultaneously into the upper socket 4*a* because of the opposite thread. When the couplers 5** have been screwed in almost to their full extent, sufficient strength will have been achieved if the couplings are suitable arranged, to permit the removal of the crane. It is then possible to make fine adjustments to the level and verticality of the column without using the main lifting device of the tower crane, which lacks a degree of fine control.

In the embodiment described, the metal sockets are flush with the end surfaces. However, according other embodiments, either or both columns may have sockets which project from the end face of the column.

What we claim is:

1. A method of joining spaced elongate vertical columns of concrete which comprises providing in a face of each column at least one screw threaded metal socket, the socket in one column having a thread opposite in direction to that in the socket of the other column, positioning one column over the other and spaced therefrom with the mouth of a socket in one column aligned with the mouth of the socket in the other column, locating between the two sockets an elongate coupling having an externally threaded portion at each end and an intermediate portion between the end portions and including a grip surface portion, the thread of one end portion being opposite in direction to that on the other end portion, and rotating the coupling by its grip surface while said columns are spaced so as to simultaneously screw the threaded portions into the corresponding sockets a sufficient distance to adjust the spacing between said sockets such that the upper column remains spaced above the lower column but supported thereon by the connection between the sockets and the coupling, with the spacing between the sockets being defined by the length of the intermediate portion of the coupling.--

2. A method according to claim 1, which also comprises swaging an unthreaded portion of each socket on to the end of respective concrete reinforcing bars, and casting a body of concrete about at least one of the bars such that at least the mouth of each socket is accessible.

3. A method according to claim 2, wherein the columns are for use in the construction of a multi-storey structure.--

4. A method according to claim 3, wherein three couplings and three pairs of opposed sockets are used to connect the two columns, the sockets being arranged in a triangular array.

5. A method according to claim 4 wherein said multi-storey structure is a building.--

* * * * *